US008325172B2

(12) United States Patent
Yonemochi

(10) Patent No.: US 8,325,172 B2
(45) Date of Patent: Dec. 4, 2012

(54) DRIVER CIRCUIT, METHOD FOR DRIVING, ELECTRO-OPTICAL DEVICE AND ELECTRONIC APPARATUS

(75) Inventor: Akihiko Yonemochi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 553 days.

(21) Appl. No.: 12/393,714

(22) Filed: Feb. 26, 2009

(65) Prior Publication Data

US 2009/0219269 A1 Sep. 3, 2009

(30) Foreign Application Priority Data

Feb. 29, 2008 (JP) ..... 2008-049295

(51) Int. Cl.
*G09G 5/00* (2006.01)

(52) U.S. Cl. ..... 345/208

(58) Field of Classification Search ..... None
See application file for complete search history.

(56) References Cited

U.S. PATENT DOCUMENTS 5,557,363 A 9/1996 Kunishige et al.
5,642,134 A 6/1997 Ikeda
5,708,880 A 1/1998 Kunishige et al.
6,980,191 B2 * 12/2005 Nakamura et al. ..... 345/98
7,053,888 B2 * 5/2006 Ando ..... 345/204
7,106,295 B2 * 9/2006 Watanabe et al. ..... 345/103
7,196,685 B2 * 3/2007 Lee et al. ..... 345/99
7,817,169 B2 * 10/2010 Endo et al. ..... 345/690

FOREIGN PATENT DOCUMENTS

JP 05-150751 A 6/1993
JP 5-150751 A 6/1993
JP 06-268524 A 9/1994
JP 08-146381 A 6/1996

* cited by examiner

*Primary Examiner* — K. Wong
(74) *Attorney, Agent, or Firm* — AdvantEdge Law Group, LLC

(57) ABSTRACT

A driver circuit includes a plurality of data signal output units each configured to provide the electro-optical device with the data signal, a timing signal output unit configured to provide the electro-optical device with the timing signals, a detection unit configured to detect signal levels of the data signals provided by the data signal output units, an adjustment unit configured to adjust the signal levels of the data signals provided by the data signal output units so as to approach one another on the basis of the detected signal levels, and a signal control unit configured to control the timing signal output unit so as to stop at least one of the timing signals before the detection unit detects the signal level.

9 Claims, 9 Drawing Sheets

DRIVER CIRCUIT, METHOD FOR DRIVING, ELECTRO-OPTICAL DEVICE AND ELECTRONIC APPARATUS

BACKGROUND

1. Technical Field

The present invention relates to a driver circuit configured to drive an electro-optical device such as a liquid crystal display device, a method for driving the electro-optical device, an electro-optical device having the driver circuit, and an electronic apparatus, e.g., a liquid crystal projector, having the electro-optical device.

2. Related Art

There is a driver circuit of this kind configured to divide a data signal for displaying a picture so as to output and write plural data signals into plural pixels simultaneously. While such a driving operation is being performed, e.g., different characteristics of output circuits may cause a variation of output data signal levels and display unevenness. Thus, methods for calibrating the signal levels of the output circuits while the driving operation is being performed so as to reduce the above variation of the signal levels have been disclosed.

For example, JP A-H05-150751 discloses a method for performing calibration during a vertical blanking interval so as to avoid an effect of a voltage variation caused by a writing operation and so forth.

In a vertical blanking interval where no writing operation is performed, however, a voltage drop of some size may occur. Thus, even if the calibration is performed during a vertical blanking interval as disclosed in JP A-H05-150751, a correct output level may not be detected in some cases. That is, the above method has a technical problem in that it is difficult to properly suppress the variation of the signal levels.

SUMMARY

An advantage of some aspects of the invention is that the signal level may be precisely calibrated by providing a driver circuit, a method for driving, an electro-optical device and an electronic apparatus.

In order to solve the above problems, a driver circuit configured to provide an electro-optical device with a data signal and a plurality of timing signals for specifying each of timings of providing the data signal, so as to drive the electro-optical device, is provided. The driver circuit includes a plurality of data signal output units configured to provide the electro-optical device with the data signal, a timing signal output unit configured to provide the electro-optical device with the plurality of timing signals, a detection unit configured to detect a signal level of the data signal provided by each of the data signal output units, an adjustment unit configured to adjust the signal level of the data signal provided by each of the data signal output units to approaching one another on the basis of the detected signal level, and a signal control unit configured to control the timing signal output unit so as to stop at least one of the timing signals before the detection unit detects the signal level.

According to the driver circuit of the invention, the plural data signal output units provide the electro-optical device with the data signal during operation. That is, the data signal is divided and is provided by each of the plural data signal output units. In this way, the electro-optical device may simultaneously write the divided data signals into a plurality of pixels, so as to ensure there is sufficient time to write a data voltage into each of the pixels. Thus, even an electro-optical device having, e.g., a high resolution panel may perform a stable display operation.

The timing signal output unit provides the electro-optical device with a plurality of timing signals each of which specifies a timing of providing the data signal, in addition to the data signal described above. The term "specify the timing" means to specify an act of providing the data signal and timings of providing the data signals on a time axis, such as to specify a timing of sampling the data signal, or to limit a pulse width of the data signal. More specifically, the timing signals are, e.g., an enable signal, a start signal, a clock signal and so on.

As the data signal and the timing signals are provided, the electro-optical device may be provided with the data signal at a proper timing and for a proper period of time. Thus, the electro-optical device may perform a picture display by active matrix addressing in, e.g., a pixel area in which a plurality of pixels are arranged on a plane to form a matrix.

The detection unit detects a signal level (i.e., a voltage) of the data signal provided by each of the data signal output units. The adjustment unit adjusts the signal level of the data signal provided by each of the data signal output units to approaching one another on the basis of the detected signal level. The signal level adjusted here is not of a data signal for an actual picture display, but of a data signal for trying to output a same data signal. That is, the signal level is adjusted so that a variation of the signal levels of the divided data signals may be reduced among the plural data signal output units.

As the variation of the signal levels is reduced as described above, the electro-optical device may reduce occurrences of display unevenness. That is, the electro-optical device may avoid an abnormal display in brightness or color tones caused by the variation of the signal levels of the divided data signals.

According to the invention, in particular, the signal control unit controls the timing signal output unit so as to stop at least one of the plural timing signals, before the signal level is detected as described above. The timing signal is typically formed by switch operations between high and low voltages. Thus, the term "stop" means to stop the switch operations as well as to stop an application of the voltage.

Unless the timing signal is stopped, it is feared that the driver circuit, being affected by driving the electro-optical device, may not precisely detect the signal level of the data signal and may not properly adjust the signal level. More specifically, an operation of, e.g., writing into pixels temporarily causes an increased value of a current, which may cause a voltage drop. At the timing of the voltage drop, a signal level lower than the signal level of the data signal to be actually provided may be detected. Thus, the adjustment unit may not properly adjust the signal level in such a case.

According to the invention, however, at least one of the plural timing signals is stopped before the detection unit detects the signal level of the data signal as described above. The voltage drop and so on described above may be reduced thereby. Thus, the signal level may be precisely detected and may be properly adjusted.

As typically a greater number of the timing signals are stopped, the signal level may be more precisely detected. In a case where only one of the timing signals is stopped though, the effect of the invention described above may be reasonably obtained. In a case where a relatively small number of the timing signals are stopped, a very high effect may be obtained if a characteristic of each of the timing signals is considered and properly combined with each other.

Although the detection unit may detect the signal level in a vertical blanking interval and so on, the signal level may vary by being affected by the timing signal in the vertical blanking interval. Thus, even in a case where the detection unit detects the data signal in the vertical blanking interval, the adjustment unit may adjust the signal level more properly upon the timing signal being stopped.

Further, as being very short, the vertical blanking interval is not sufficient for detection and adjustment of the signal level. Thus, if the signal level is detected and adjusted only in the vertical blanking interval, the detection and adjustment have to be divided into a plurality of times, possibly causing a complicated control or a complicated circuit configuration.

Meanwhile, since stopping of the timing signal is all that is required, the driver circuit of the invention may detect and adjust the signal level for a relatively long period of time. Thus, the driver circuit of the invention may reduce the variation of the signal level of the data signal by using a simpler control and a simpler circuit configuration. Although it may be thought that a displayed picture may be disturbed due to the stopping of the timing signal, the display is actually less affected as an effect of adjusting the signal level once may be maintained until the device restarts. If being controlled so that the timing signal is stopped while a static picture or a moving picture with less motion is being displayed, the driver circuit may reduce the failure described above to such an extent as to be hardly or not at all visually perceived.

As described above, the driver circuit of the invention may more precisely detect the signal level by stopping the timing signal, and may properly adjust the signal level, thereby. Thus, the driver circuit may display a picture of higher quality.

According to an embodiment of the invention, the driver circuit further has a switch unit configured to switch the data signal provided by the plural data signal output units to a first reference signal before the detection unit detects the signal level.

According to the above embodiment, the switch unit switches the data signal provided by the plural data signal output units to the first reference signal before the detection unit detects the signal level of the data signal. The "first reference signal" is a signal used for detecting a variation of the signal levels provided by the plural data signal output units, and having a preset signal level.

As the data signal is switched to the first reference signal, the plural data signal output units may be controlled so as to provide the signals of a same level. Thus, the detection unit may surely detect an extent of variation of the provided data signals among the plural data signal output units. The variation of the signal level of the data signal may be more easily and properly reduced, thereby. That is, the adjustment unit may more preferably adjust the signal level.

The embodiment having the switch unit described above may further has a second reference signal output unit and an arithmetic unit. The second reference signal output unit is configured to output a second reference signal having a signal level corresponding to a signal level of the first reference signal before the detection unit detects the signal level. The arithmetic unit is configured to calculate a difference between the signal level of the data signal provided by each of the data signal output units and the signal level of the second reference signal. The adjustment unit may be configured to adjust the signal level of the data signal provided by each of the data signal output units on the basis of the difference.

According to the above configuration, the second reference signal output unit outputs the second reference signal before the detection unit detects the signal level of the data signal. The second reference signal has a signal level corresponding to the signal level of the first reference signal, and may be same as the first reference signal.

Then, the arithmetic unit calculates a difference between the signal level of the data signal provided by each of the data signal output units and the signal level of the second reference signal. To what extent the provided data signal varies among the plural data signal output units may be precisely known on the basis of the difference. The adjustment unit may more easily and properly reduce the variation of the signal level of the data signal. That is, the adjustment unit may more preferably adjust the signal level.

According to another embodiment of the driver circuit of the invention, the detection unit is configured to detect the signal level in a determined period of time after a power supply of the electro-optical device is turned on.

According to the above embodiment, the detection unit detects the signal level in the determined period of time after the power supply of the electro-optical device is turned on. The "determined period of time" means here a period of time that is sufficient so that the adjustment unit may adequately adjust the data signal, and may change depending on a circuit configuration and so on. More specifically, it is, e.g., one millisecond to 1.5 seconds, and may be set as a period of time between the turn on of the power supply and the beginning of an actual picture display operation. Thus, even if the display is disturbed due to the stopping of the timing signal, the disturbance may be suppressed to such an extent as to be hardly or not at all visually perceived. That is, the failure due to the stopping of the timing signal may be effectively reduced.

According to yet another embodiment of the driver circuit of the invention, the signal control unit is configured to control the timing signal output unit so as to stop an enable signal that is one of the timing signals.

According to the above embodiment, before the detection unit detects the signal level of the data signal, the signal control unit controls the timing signal output unit so as to stop the enable signal. The "enable signal" is a signal specifying a timing and an interval of writing the data signal.

The electro-optical device does not write the data signal in the pixels after the enable signal is stopped, and may reduce a voltage drop caused by, e.g., a current increase, thereby. Thus, the detection unit may precisely detect the signal level and the adjustment unit may properly adjust the signal level. As the writing operation is only temporarily paused, the display operation is less affected in the case where the enable signal is stopped than in a case where another one of the timing signals, e.g., a start signal or a clock signal is stopped. Thus, while display failures may be suppressed, the signal level may be preferably adjusted.

The electro-optical device of the invention includes the driver circuit (and the embodiments of the driver circuit) of the invention so as to solve the above problem.

As including the driver circuit of the invention described above, the electro-optical device of the invention may be provided with the data signal having been adjusted to have a small variation. Thus, the electro-optical device may effectively prevent a failure such as display unevenness, and may display a picture of high quality, thereby.

The electronic apparatus of the invention includes the electro-optical device (and the embodiments of the electro-optical device) of the invention described above so as to solve the above problem.

As having the electro-optical device of the invention described above, the electronic apparatus of the invention may be applied to implementation of a projection type display, a TV, a mobile phone, a personal digital assistant, a word processor, a video tape recorder of a viewfinder type or of a direct monitor type, a workstation, a TV phone, a POS terminal, a device having a touch panel and so on.

In order to solve the above problem, the driving method of the invention is a method for driving an electro-optical device by providing the electro-optical device with a data signal and a plurality of timing signals for specifying each of timings of providing the data signal. The driving method includes providing the electro-optical device with the data signal after dividing the data signal into a plurality of divided data signals, providing the electro-optical device with the timing signals, detecting a signal level of each of the divided data signals, adjusting the signal level of each of the divided data signals to approaching one another on the basis of the detected signal level, and controlling the timing signals so as to stop at least one of the timing signals before detecting the signal level.

According to the driving method of the invention, at least one of the plural timing signals is stopped before the signal level of the data signal is detected, as described above with respect to the driver circuit of the invention. The signal level may be more precisely detected and the signal level of the data signal may be properly adjusted, thereby. Thus, a picture of higher quality may be displayed.

The driving method of the invention may be variously modified as described above with respect to the driver circuit of the invention.

An effect and another advantage of the invention will be explained by following embodiments.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings.

Driver Circuit and Method for Driving

A driver circuit and a driving method of the embodiment will be described with reference to FIGS. 1-5.

Figure 1:
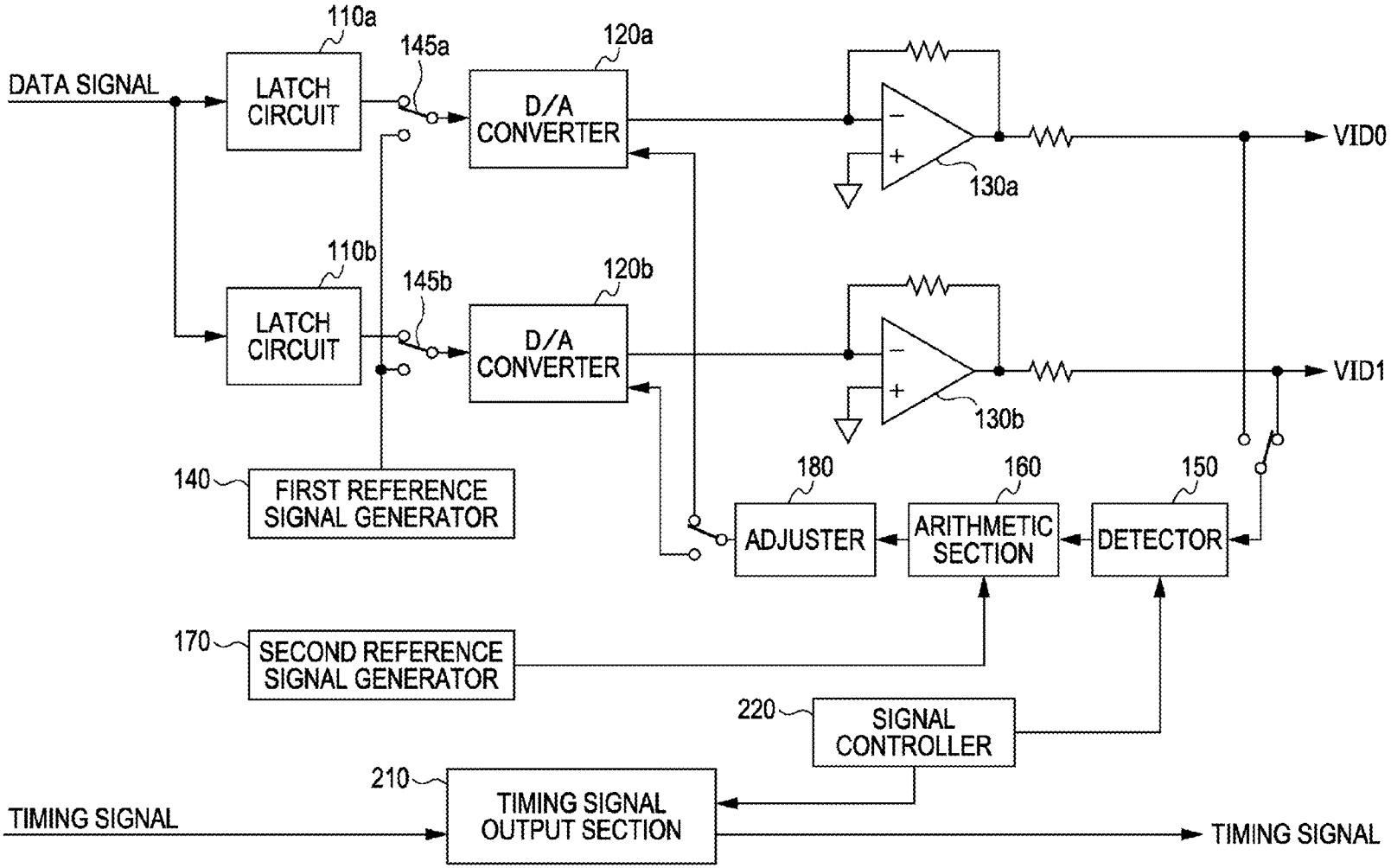
FIG. 1 is a block diagram showing a configuration of a driver circuit of an embodiment.
Figure 2:
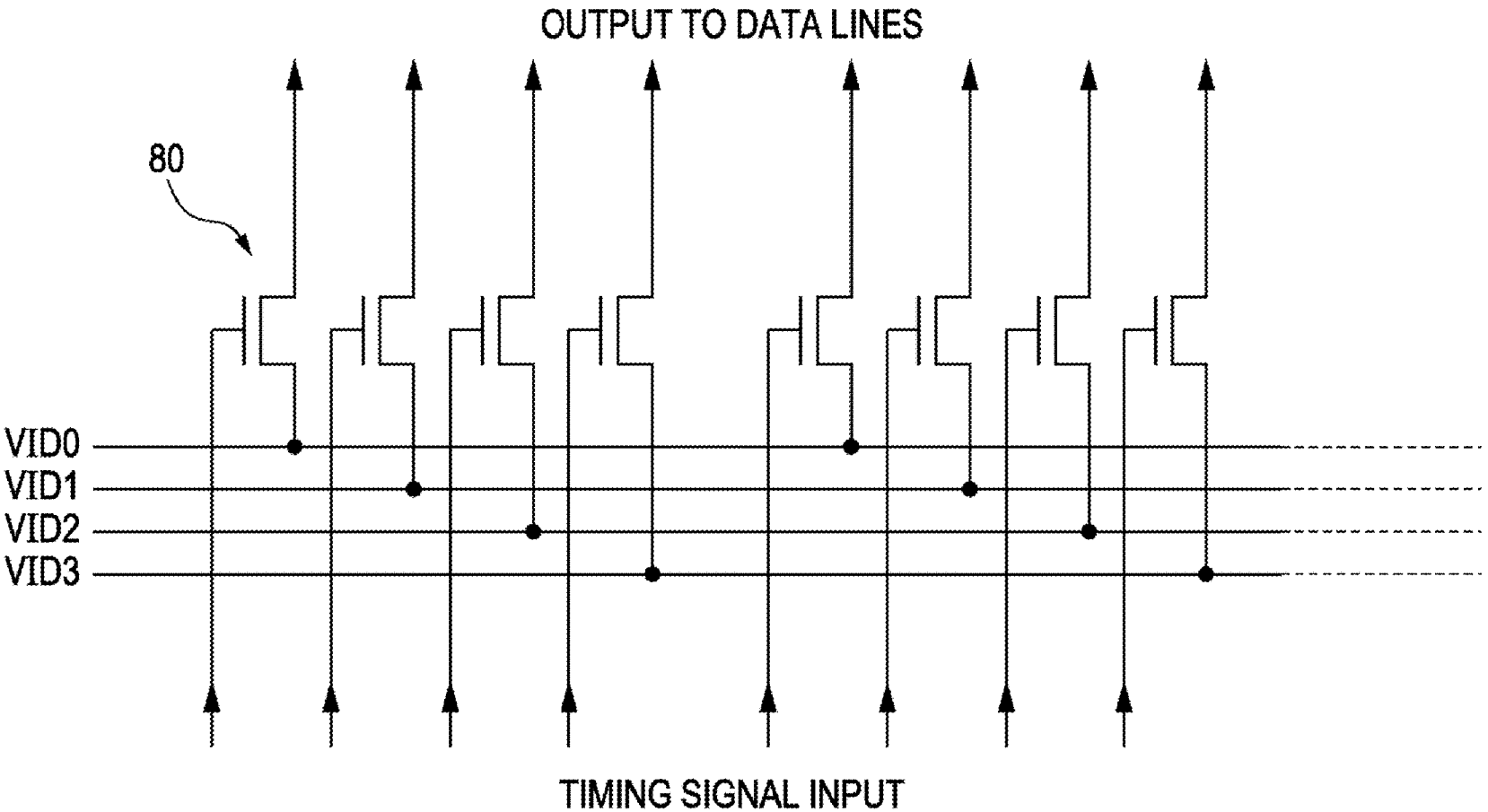
FIG. 2 is a block diagram of a sampling circuit configured to provide an electro-optical device with an image signal.

First, a configuration of the driver circuit of the embodiment will be described with reference to FIGS. 1-2. FIG. 1 is a block diagram showing the configuration of the driver circuit of the embodiment. FIG. 2 is a block diagram showing a configuration of a sampling circuit configured to provide an electro-optical device with an image signal. Although in FIG. 1 an input data signal is shown as being divided into two signals (VID0 and VID1), an input data signal is typically divided into more (e.g., six or twelve) signals to be output.

As shown in FIG. 1, the driver circuit of the embodiment has a plurality of latch circuits 110, a plurality of D/A (Digital to Analog) converters 120, a plurality of output circuits 130, a first reference signal generator 140, a plurality of switches 145, a detector 150, an arithmetic section 160, a second reference signal generator 170, an adjuster 180, a timing signal output section 210 and a signal controller 220.

The latch circuit 110 is an electronic circuit configured to temporarily store an input data signal and then output the stored signal in sequence. The plural latch circuits 110 are provided in a number corresponding to the number of plural divided data signals.

The D/A converter 120 is an electronic circuit configured to D/A convert an input data signal and output the converted signal. The plural D/A converters 120 are provided in a number corresponding to the number of plural divided data signals.

The output circuit 130 is an example of the "data signal output unit" of the invention, and is configured to amplify an input data signal and output the amplified signal. The plural output circuits 130 are provided in a number corresponding to the number of plural divided data signals, as well as the latch circuits 110 and the D/A converters 120.

The first reference signal generator 140 and the switch 145 are an example of the "switch unit" of the invention, and are configured in such a way that the switch 145 may be switched so that the first reference signal generator 140 may provide the D/A converter 120 with a first reference signal instead of the data signal provided by the latch circuit 110.

The detector 150 is an example of the "detection unit" of the invention, and is configured to detect a signal level of the data signal provided by the output circuit 130*a* or 130*b*.

The arithmetic section 160 is an example of the "arithmetic unit" of the invention, and is an arithmetic circuit configured to calculate a difference between a signal level of a second reference signal provided by the second reference signal generator 170, which is an example of the "second reference signal output unit" of the invention, and the signal level detected by the detector 150.

The adjuster 180 is an example of the "adjustment unit" of the invention, and is configured to adjust the output of the D/A converter 120 on the basis of the difference calculated by the arithmetic section 160.

The timing signal output section 210 is an example of the "timing signal output unit" of the invention, and is configured to output a plurality of timing signals which specify timings at which the data signals are to be provided. The timing signal output section 210, only one of which is shown in FIG. 1, may be provided in a number corresponding to the number of timing signals, though.

The signal controller 220 is configured to control the timing signal output section 210 so as to stop at least one of the plural timing signals. The signal controller 220 is electrically connected to the detector 150, and is configured to notify the detector 150 that the timing signal has been stopped.

As shown in FIG. 2, the image signals VID are provided by the driver circuit described above to data lines of the electro-optical device through sampling switches 80, which may be switched by a timing signal such as an enable signal. In this way, the electro-optical device may simultaneously write the data signals into a plurality of pixels, so as to ensure there is sufficient time to write a data voltage into each of the pixels. Thus, even an electro-optical device having a panel of high resolution, e.g., may perform a stable display operation. FIG. 2 shows a case where the image signal is divided into four signals, VID0-VID3, to be provided (i.e., a case of four-phase expansion driving).

Figure 3:
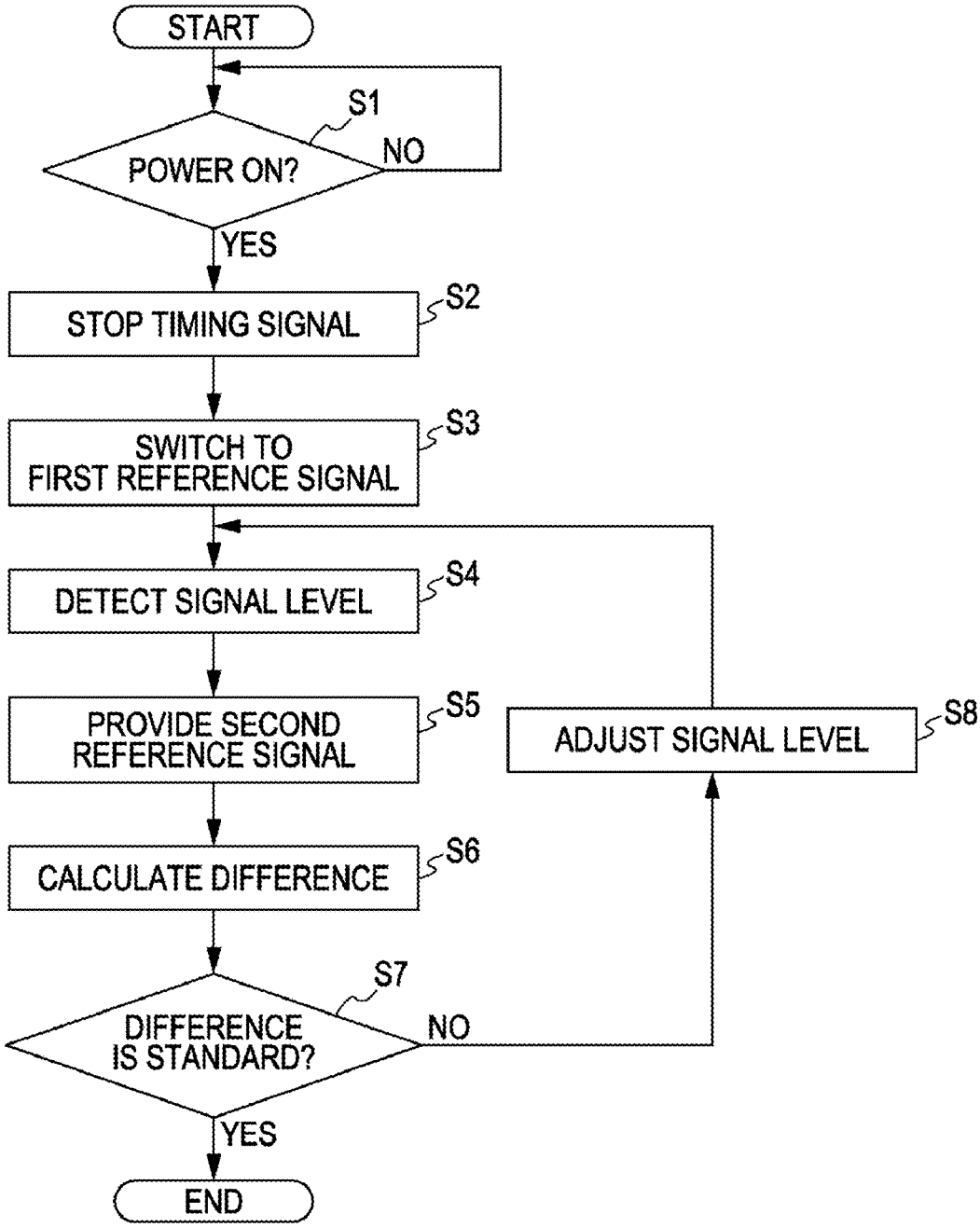
FIG. 3 is a flowchart showing a flow of a driving method of the embodiment.
Figure 4:
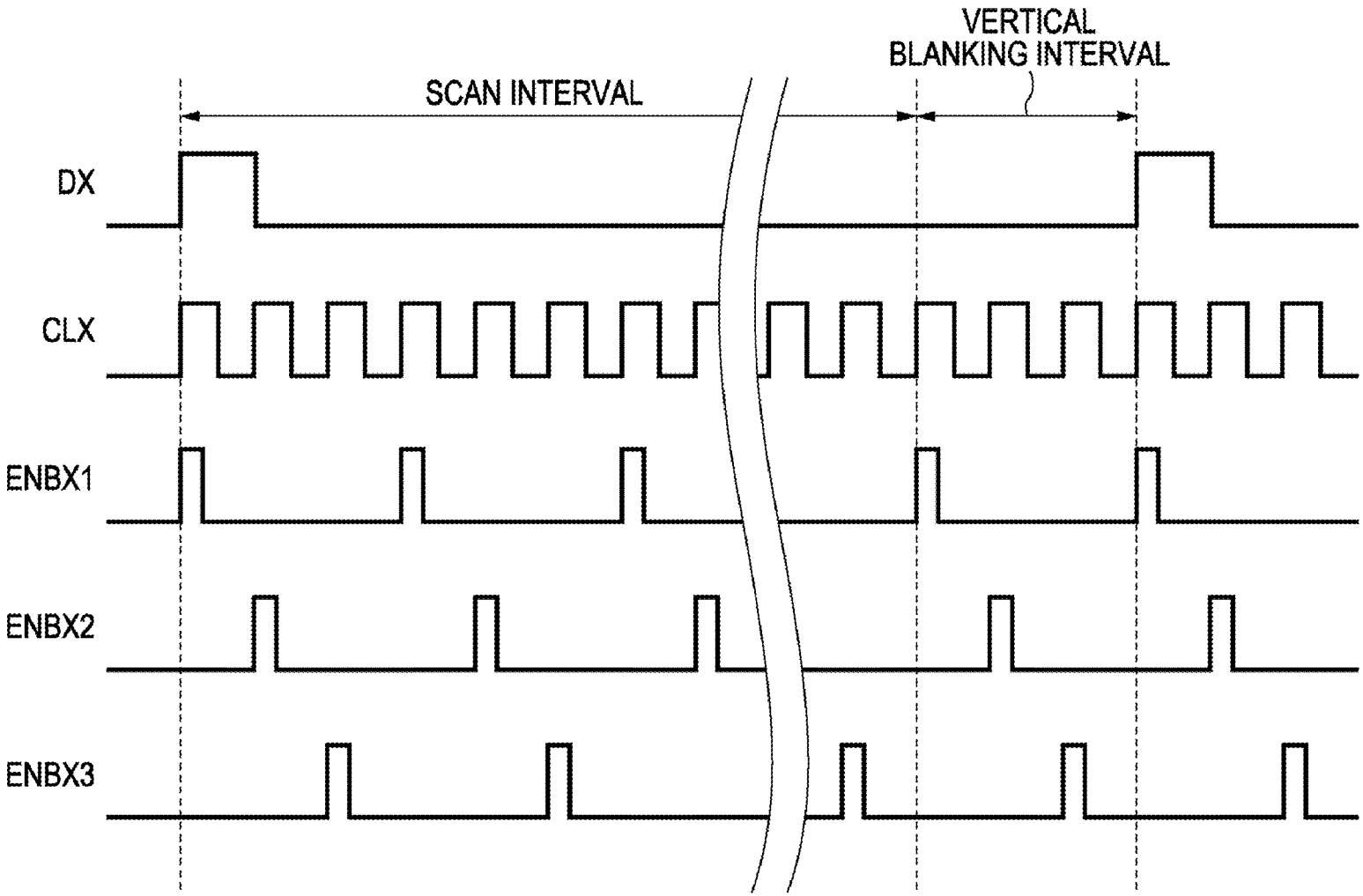
FIG. 4 is a timing chart showing a waveform of each of timing signals.
Figure 5:
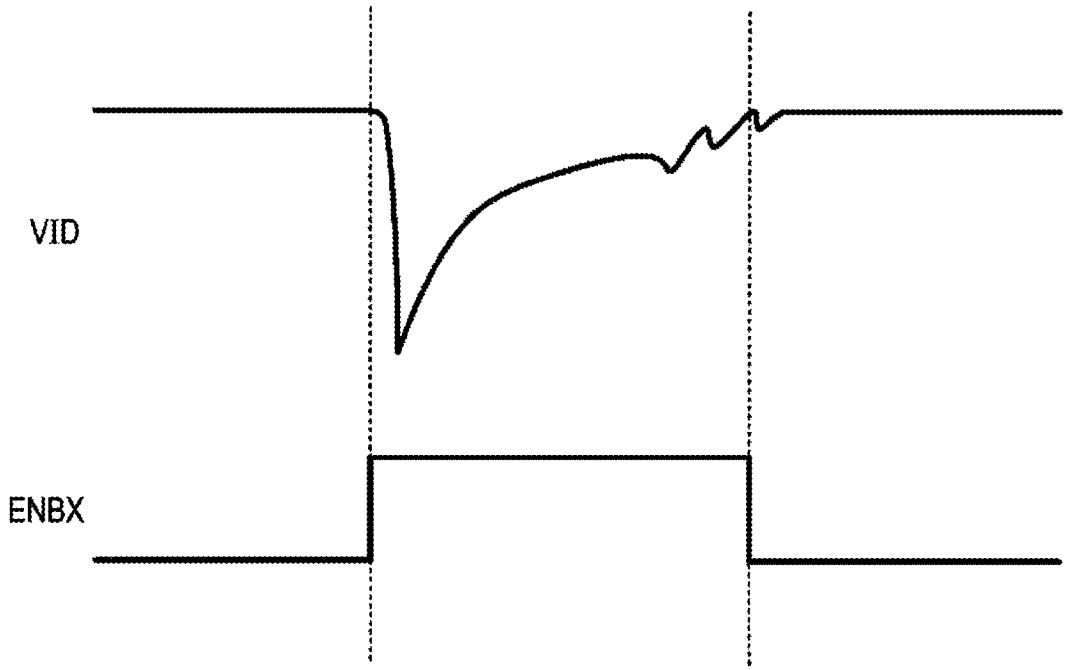
FIG. 5 is a waveform diagram showing a change of a signal level when a data signal is written.
Figure 6:
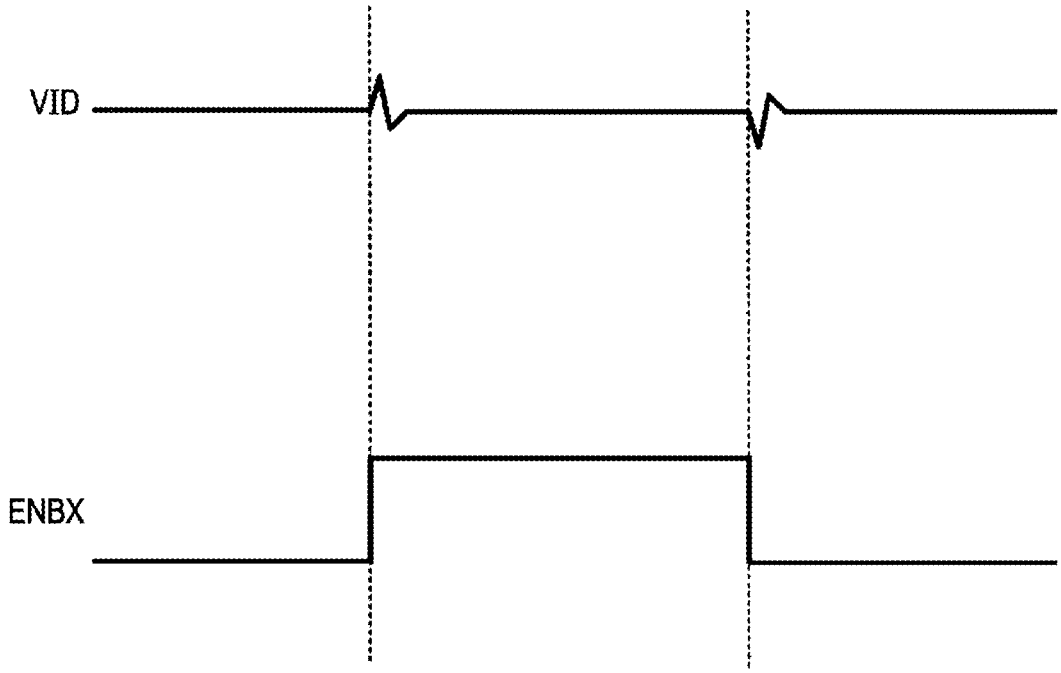
FIG. 6 is a waveform diagram showing a change in the signal level when no data signal is written.

A driving method of the embodiment will be described with reference to FIGS. 3-6 in addition to FIG. 1. FIG. 3 is a flowchart showing a flow of the driving method of the embodiment. FIG. 4 is a timing chart showing a waveform of each of the timing signals. FIG. 5 is a waveform diagram showing a change in the signal level when the data signal is written. FIG. 6 is a waveform diagram showing a change in the signal level when no data signal is written. Hereinafter, the driving method of the embodiment and the operation of the driver circuit of the embodiment described above will be described together.

As shown in FIG. 1 and FIG. 3, the driver circuit of the embodiment, first in its operation, determines whether a power supply of the electro-optical device to be driven has been turned on or not (step S1). If the power supply has been turned on (step S1: YES), the signal controller 220 stops at least one of the plural timing signals provided by the timing signal output section 210 (step S2). The timing signals are signals for specifying timings of sampling the data signals and for limiting pulse widths of the data signals, such as an enable signal, a start signal or a clock signal. Having stopped the timing signal, the signal controller 220 notifies the detector 150 that the timing signal has been stopped.

Then, the first reference signal generator 140 provides the first reference signal, and the switches 145*a* and 145*b* are switched, so that each of the D/A converters 120*a* and 120*b* is provided with the first reference signal (step S3). That is, the D/A converters 120*a* and 120*b* are provided with the first reference signal instead of the data signals for displaying a picture provided through the latch circuits 110*a* and 110*b*. Consequently, each of the output circuits 130*a* and 130*b* outputs the first reference signal.

If the signal controller 220 stops the timing signal, the detector 150 detects the signal level of the data signal provided by the output circuit 130*a* or 130*b* (i.e., the first reference signal at this moment) (step S4). The arithmetic section 160 is provided with the detected signal level.

If the signal level is detected, the second reference signal generator 170 provides the arithmetic section 160 with the second reference signal of a level corresponding to the level of the first reference signal (step S5). Then, the arithmetic section 160 calculates a difference between the signal level detected by the detector 150 and the level of the second reference signal (step S6). That is, a difference between the level of the first reference signal provided by the output circuit 130*a* and the level of the second reference signal, and a difference between the level of the first reference signal provided by the output circuit 130*b* and the level of the second reference signal, are calculated at this step. The adjuster 180 is provided with the calculated difference.

Upon being provided with a difference, the adjuster 180 determines whether the difference reaches a standard value (step S7). That is, the adjuster 180 determines whether the difference reaches the standard value that is preset for adjusting the signal level. If every calculated difference reaches the standard value (step S7: YES), the process ends here. If any one of the calculated differences does not reach the standard value (step S7: NO), the adjuster 180 adjusts the outputs of the D/A converters 120*a* and 120*b* so that the value of the calculated difference may approach the standard value (step S8). That is, the adjuster 180 adjusts the levels of the signals provided by the output circuit 130*a* and the output circuit 130*b* so that they approach each other. Thus, a variation of the signal levels at the output circuits 130*a* and 130*b* may be reduced. In a case where the driver circuit has more than two output circuits 130 (i.e., the data signal is divided into no less than three signals), the variation of the signal levels may be reduced in a similar manner.

As shown in FIG. 4, during normal operation, the driver circuit of the embodiment is provided with several kinds of timing signals. For example, at the beginning of a scan interval, a start signal DX is provided. A clock signal CLX is provided at a predetermined interval so as to synchronize the timing signals. An enable signal ENBX is provided as each of a plurality of signals ENBX1, ENBX2 and ENBX3. In this way, timings at which the data signals are to be written are specified. More specifically, the sampling switches 80 shown in FIG. 2 are switched so that the timings at which the data signals are to be provided may be controlled. The number of the enable signals ENBX is not limited to three as described above.

If the enable signal ENBX is provided, the data signal VID provided to be written by the output circuit 130 changes as shown in FIG. 5. That is, the writing operation increases an amount of current and causes a voltage drop, so that the signal level temporarily extremely drops. Thus, if the detector 150 detects the dropped signal level, the difference calculated by the arithmetic section 160 may be incorrect, and the adjuster 180 may be unable to perform precise adjustment.

As shown in FIG. 6, on the other hand, even in an interval where no writing operation is performed such as the vertical blanking interval shown in FIG. 4, the level of the image signal changes somewhat if the timing signal is provided. Thus, in a case where the signal level is detected in the vertical blanking interval, the difference calculated by the arithmetic section 160 may be incorrect as long as the timing signal is provided. Thus, the adjuster 180 may be unable to perform precise adjustment.

Meanwhile, as described above, as the signal controller 220 stops the timing signal beforehand, the driver circuit of the embodiment may detect the signal level while preventing the voltage drop and so on. Thus, the driver circuit of the embodiment may precisely detect the signal level and properly adjust the signal level. The stopping of the timing signal may be controlled by, e.g., a digital signal, and thus may be implemented by a relatively simple circuit configuration.

The timing signal to be stopped is not limited to the enable signal ENBX, and may be any one of the plural timing signals. By stopping no less than two (preferably all) timing signals, the driver circuit of the embodiment may detect the signal level more precisely.

Referring back to FIG. 3, after the signal level is adjusted, the process of the steps S4-S7 is repeated. That is, the signal level is adjusted until every difference reaches the standard value. It typically takes one millisecond to 1.5 seconds to complete the above process. With regards to the embodiment, in particular, as the process starts after the power supply of the electro-optical device is turned on, the above process may be completed before a picture is actually displayed. That is, even in a case where a picture to be displayed is disturbed, such a failure may be reduced to such an extent as to be hardly or not at all visually perceived due to the stopping of the timing signal.

After the above process is completed, the signal controller 220 controls the timing signal output section 210 so that the timing signal that had been stopped is provided. Once the signal level is adjusted, the effect of the adjustment may typically continue until the device restarts. Thus, it is not necessary to stop the timing signal again during the display operation.

If the stopping of the timing signal is canceled, the switches 145*a* and 145*b* are switched again. Then, the data signal is applied to the D/A converters 120*a* and 120*b* through the latch circuits 110*a* and 110*b*. That is, the driver circuit starts a regular display operation of a picture.

As described above, the driver circuit of the embodiment may detect the signal level more precisely by stopping the timing signal, in accordance with the driving method of the embodiment. Thus, the driver circuit may properly adjust the signal level of the data signal, and may display a picture of higher quality thereby.

Electro-Optical Device

An electro-optical device to which the driver circuit described above is applied will be described with reference to FIGS. 7-9. The following description of the embodiment will give an example of a TFT (thin film transistor) active matrix driving type liquid crystal device.

First, a configuration of an electro-optical panel of the electro-optical device of the embodiment will be described with reference to FIGS. 7-8. FIG. 7 is a plan view showing the configuration of the electro-optical panel of the embodiment. FIG. 8 is a cross-sectional view along a line H-H' shown in FIG. 7.

Figure 7:
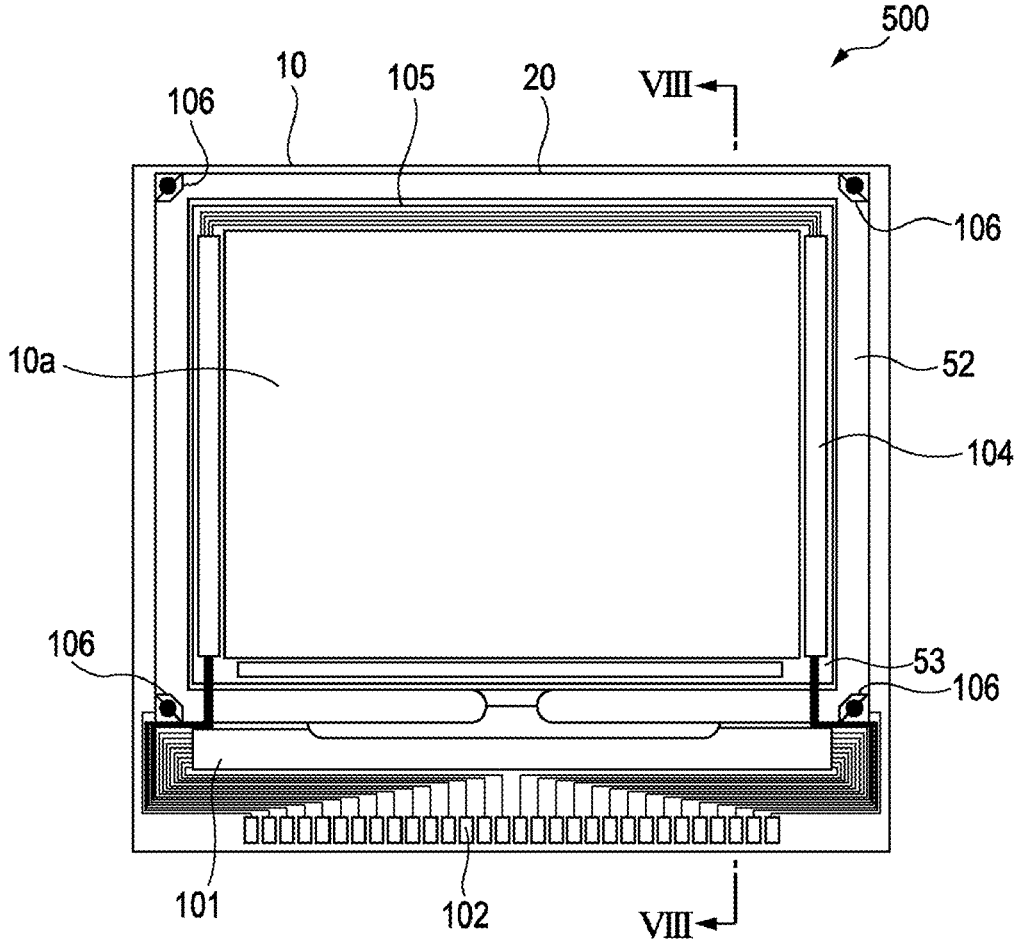
FIG. 7 is a plan view showing a configuration of an electro-optical panel of the electro-optical device of the embodiment.
Figure 8:
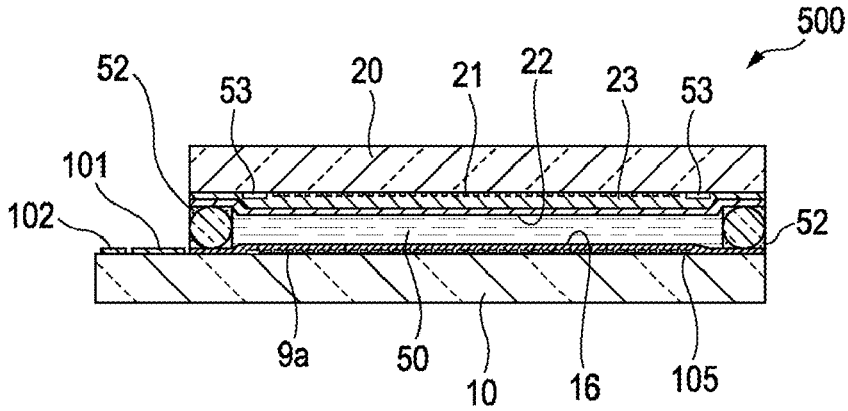
FIG. 8 is a cross-sectional view along the "H-H'" line shown in FIG. 7.

As shown in FIGS. 7-8, the electro-optical panel 500 has a TFT array substrate 10 and an opposite substrate 20 which are arranged opposite each other. The TFT array substrate 10 is, e.g., a transparent substrate such as a quartz or glass substrate, or a silicon substrate. The opposite substrate 20 is, e.g., a transparent substrate such as a quartz or glass substrate. Between the TFT array substrate 10 and the opposite substrate 20, a liquid crystal layer 50 is enclosed. The liquid crystal layer 50 is formed of liquid crystal mixed with one or a few kinds of nematic liquid crystal. The liquid crystal layer 50 is in a predetermined orientation state between a pair of orientation membranes such as the TFT array substrate and the opposite substrate. The TFT array substrate 10 and the opposite substrate 20 are adhered to each other by using a seal material 52 that is provided in a seal area located around a picture display area 10*a* in which a plurality of pixel electrodes are provided.

The seal material 52 is made of, e.g., ultraviolet hardening resin, heat hardening resin and so on for adhering the substrates to each other. The seal material 52 is applied to the TFT array substrate 10, and is then hardened by ultraviolet ray illumination, heating or the like in a manufacturing process. In the seal material 52, gap material such as glass fibers or glass beads is scattered in order that the gap between the TFT array substrate 10 and the opposite substrate 20 (i.e., the inter-substrate gap) has a determined thickness. The gap material may be arranged in the picture display area 10*a* or in a surrounding area surrounding the picture display area 10*a*, in addition to or instead of being mixed in the seal material 52.

The electro-optical panel 500 includes a frame-shaped light-blocking membrane 53 having a light-blocking characteristic defining a frame of the picture display area 10*a*. The frame-shaped light-blocking membrane 53 is arranged parallel to the inside of the seal area in which the seal material 53 is provided, and on the opposite substrate 20 side. The light-blocking membrane 53 may be partially or entirely provided as a built-in light-blocking membrane on the TFT array substrate 10 side.

The surrounding area includes a sub-area located outside of the seal area in which the seal material 52 is arranged. In the above sub-area, a data line driving circuit 101 and an external circuit connection terminal 102 are provided along a side of the TFT array substrate 10. Scan line driving circuits 104 are provided along two sides adjacent to the above side and in such a way as to be covered by the frame-shaped light-blocking membrane 53. Further, in order to connect the two scan line driving circuits 104 arranged on both sides of the picture display area 10*a*, a plurality of lines 105 are provided along a remaining side of the TFT substrate 10 in such a way as to be covered by the frame-shaped light-blocking membrane 53.

The TFT array substrate 10 has vertical connection terminals 106 which are arranged in portions facing four corner areas of the opposite substrate 20, so as to connect the both substrates through vertical connection material 107. The TFT substrate 10 and the opposite substrate 20 may be electrically connected, thereby.

On the TFT array substrate 10 shown in FIG. 8, a layered structure is formed by the TFTs which are driver elements for switching pixels, the scan lines, the data lines and so on. Details of the layered structure are omitted from FIG. 8. On the layered structure, a plurality of pixel electrodes 9*a* made of transparent material such as indium tin oxide (ITO) are formed so as to each have an island shape using a predetermined pattern for each of the pixels.

The pixel electrodes 9*a* are formed in the picture display area 10*a* on the TFT array substrate 10 in such a way as to face opposite electrodes 21. On a surface of the TFT array substrate 10 facing the liquid crystal layer 50, i.e., on the pixel electrodes 9*a*, an orientation membrane 16 is formed in such a way as to cover the pixel electrodes 9*a*.

A light-blocking membrane 23 is formed on a face of the opposite substrate 20 facing the TFT array substrate 10. The light-blocking membrane 23 is, e.g., formed in a lattice shape on the face of the opposite substrate 20 facing the TFT array substrate 10, as seen in a plan view. The light-blocking membrane 23 defines a non-aperture area. The light-blocking membrane 23 partitions an aperture area off through which light emitted by a projector lamp or a direct backlight may pass. The light-blocking membrane 23, being stripe-shaped, and various components such as the data lines arranged on the TFT array substrate 10 side may define the non-aperture area.

On the light-blocking membrane 23, the opposite electrodes 21 made of transparent material such as ITO are formed in such a way as to be positioned opposite the plural pixel electrodes 9*a*. On the light-blocking membrane 23, a color filter that is not shown in FIG. 8 may be formed in an area including the aperture area and a portion of the non-aperture area, so that a color picture may be displayed in the picture display area 10*a*. On the face of the opposite substrate 20 opposite the TFT array substrate 10, an orientation membrane 22 is formed on the opposite electrodes 21.

On the TFT array substrate 10 shown in FIGS. 7-8, a sampling circuit configured to sample the image signals (i.e., the data signals) and to provide the data lines with the sampled signals, a precharge circuit configured to provide each of the data lines with a precharge signal of a determined voltage level, prior to the image signal, and a test circuit configured to test quality, detect defects and so on of the electro-optical device before and at delivery may be formed in addition to the data line driving circuit 101 and the scan line driving circuit 104.

An electric configuration of a pixel section of the electro-optical panel 500 will be described with reference to FIG. 9. FIG. 9 is a schematic circuit diagram showing various elements and connections in a plurality of pixels arranged in a matrix and forming the picture display area of the electro-optical device of the embodiment.

Figure 9:
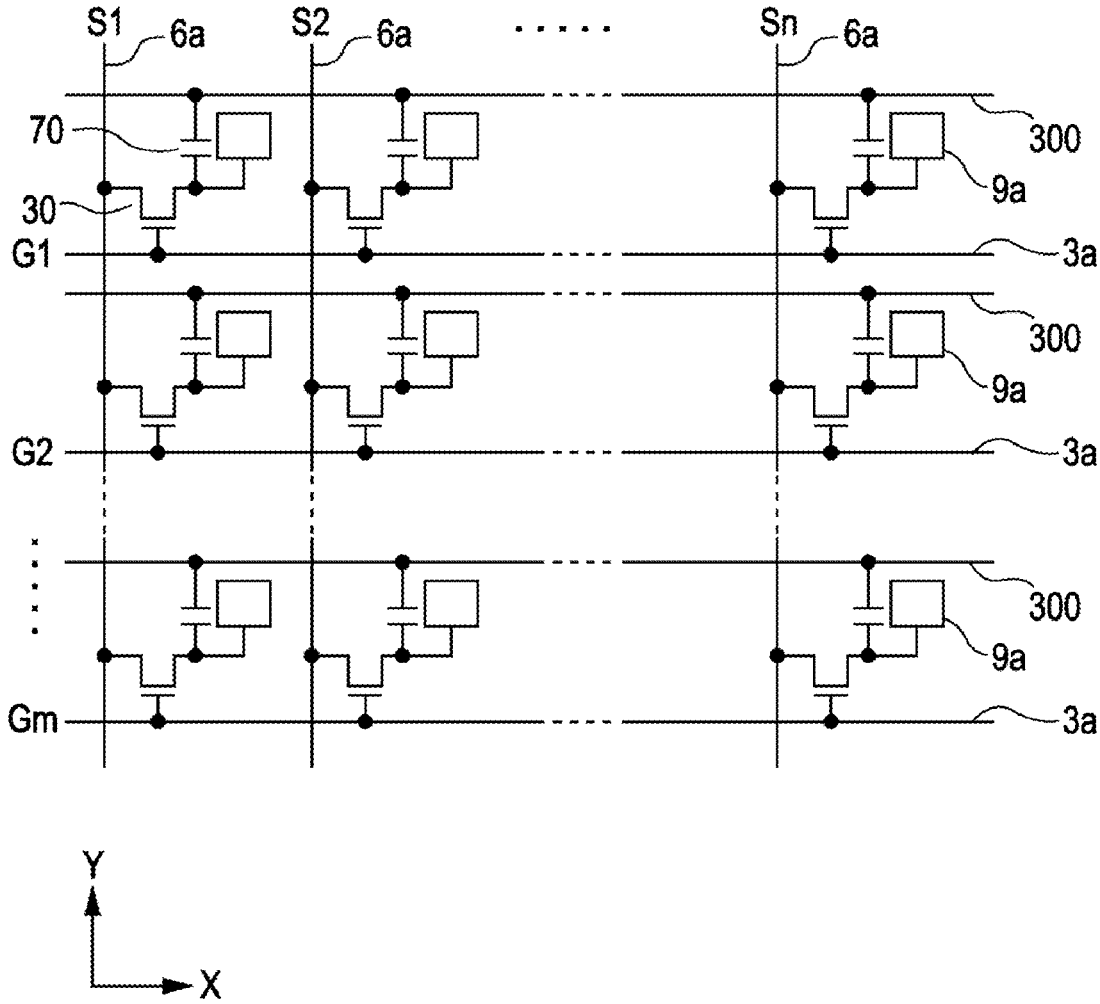
FIG. 9 is a schematic circuit diagram showing various elements, connections and so on forming a picture display area of the electro-optical device of the embodiment.

As shown in FIG. 9, the pixel electrode 9*a* and a TFT 30 are formed in each of the plural pixels arranged in a matrix and forming the picture display area 10*a*. The TFT 30 is electrically connected to the pixel electrode 9*a*, and may control switching of the pixel electrode 9*a* while the electro-optical device of the embodiment is operating. Each of data lines 6*a* shown in FIG. 9 is electrically connected to a source of the TFT 30. Each of groups of the pixels formed along each of the data lines 6*a* is provided with one of image signals S1, S2, . . . , Sn to be written into the data lines 6*a*. That is, each of the above groups formed along the data lines 6*a* is provided with the image signal by one of the output circuits 130 shown in FIG. 1.

The scan line 3*a* is electrically connected to a gate of the TFT 30. The electro-optical device of the embodiment is configured to apply scan signals G1, G2, . . . , Gm, in this order as sequential pulses to the scan lines 3*a* at determined timings. The pixel electrode 9*a* is electrically connected to a drain of the TFT 30. The TFT 30 is a switching element and the switch of the TFT 30 may be closed for a certain period of time so that the image signals S1, S2, . . . , Sn provided by the data lines 6*a* may be written into the pixel electrodes 9*a* at determined timings. The image signals S1, S2, . . . , Sn of a determined level written into liquid crystal, an example of an electro-optical material, through the pixel electrodes 9*a* may be held between the pixel electrodes 9*a* and the opposite electrodes formed on the opposite substrate 20 for a certain period of time.

The liquid crystal of the liquid crystal layer 50 (shown in FIG. 8) may modulate light by changing orientation or order of a group of molecules in accordance with an applied voltage level, and thus may perform gradation display. The liquid crystal reduces a transmission rate of incident light in accordance with a voltage applied to each of the pixels in a normally-white mode, and enhances the transmission rate of the incident light in accordance with the voltage applied to each of the pixels. The electro-optical device may emit light having contrast according to the image signals as a whole.

As shown in FIG. 9, each of the pixels includes a cumulative capacitor 70 added in parallel with a liquid crystal capacitor formed between the pixel electrode 9*a* and the opposite electrode 21 (shown in FIG. 8), so as to avoid leakage of the image signal being held. The cumulative capacitor 70 is a capacitive element that may temporarily hold the voltage applied to each of the pixel electrodes 9*a* in accordance with a supply of the image signal. One of the electrodes of the cumulative capacitor 70 is connected to the pixel electrode 9*a* and to the drain of the TFT 30 in parallel. The other of the electrodes of the cumulative capacitor 70 is connected to a capacitive line of a fixed voltage so that the voltage is fixed there. The pixel electrode 9*a* may improve display characteristics such as voltage holding, contrast and flicker reduction by including the cumulative capacitor 70.

Figure 10:
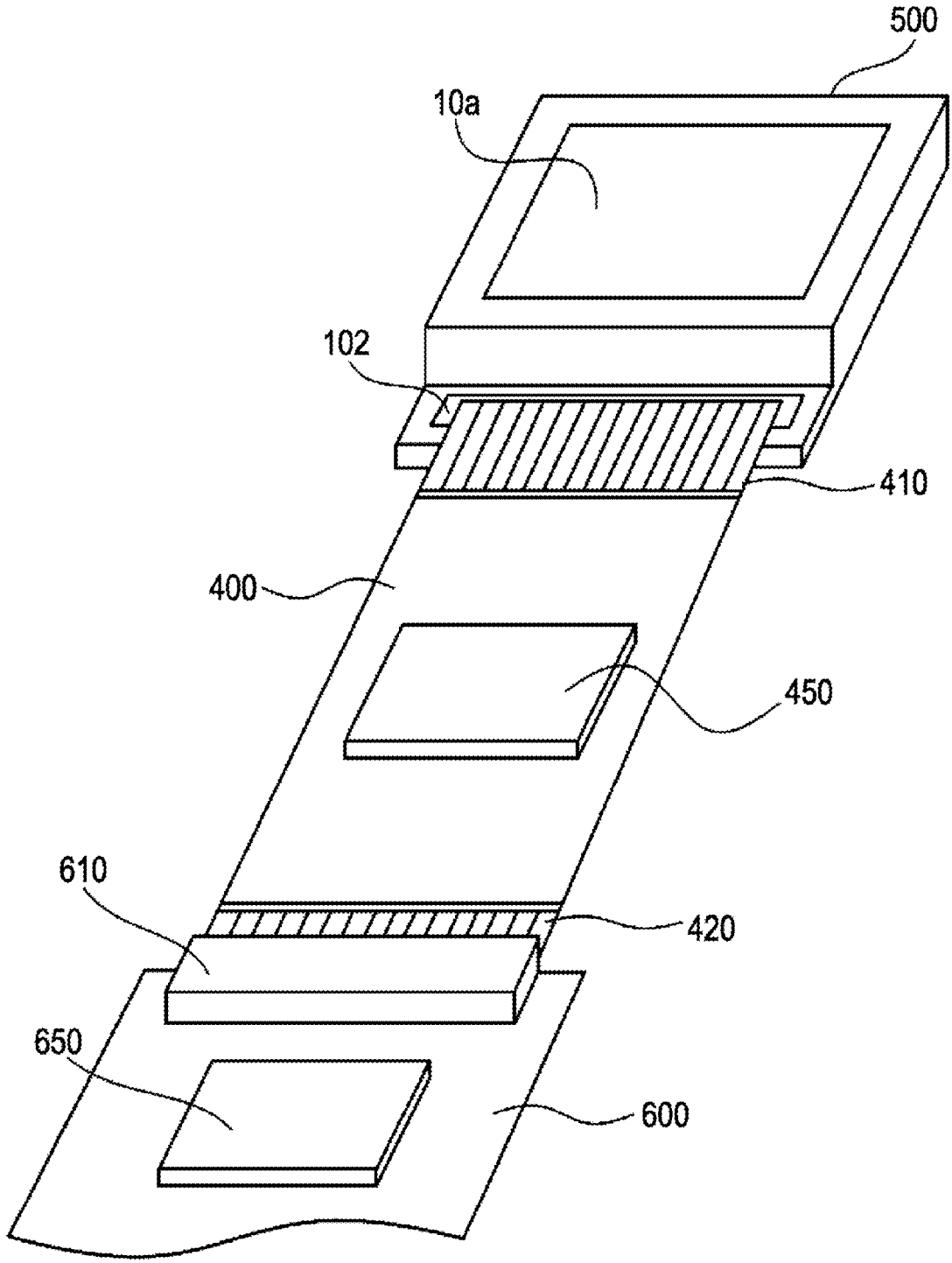
FIG. 10 is a perspective view showing an overall configuration of the electro-optical device of the embodiment.

An overall configuration of the electro-optical device of the embodiment will be described with reference to FIG. 10. FIG. 10 is a perspective view showing the overall configuration of the electro-optical device of the embodiment. In FIG. 10, the materials of the electro-optical panel 500 shown in FIGS. 8-9 in detail are omitted for convenience of explanation.

As shown in FIG. 10, the electro-optical device of the embodiment has the electro-optical panel 500 described above, a flexible printed board 400 and a circuit board 600.

The flexible printed board 400 has connection terminals 410 and 420 at both ends. The connection terminal 410 is electrically connected to the external circuit connection terminal 102 of the electro-optical panel 500. The connection terminal 420 is electrically connected to a connector 610 of the circuit board 600. That is, the electro-optical panel 500 and the circuit board 600 are electrically connected to each other through the flexible printed board 400.

Further, a first integrated circuit 450 is provided on the flexible printed board 400. The driver circuit of the embodiment described above is formed by including a portion or the whole of the first integrated circuit 450, a driver circuit contained in the electro-optical panel 500, a second integrated circuit 650 provided on the printed board 600, other integrated circuits which are not shown and so on.

As a result of having the driver circuit described above, the electro-optical device of the embodiment may appropriately adjust the level of the data signal. Thus, the electro-optical device of the embodiment may prevent degradation of picture quality caused by display unevenness occurring in the picture display area of the electro-optical panel 500, so as to display a picture of high quality.

Electronic Apparatus

Figure 11:
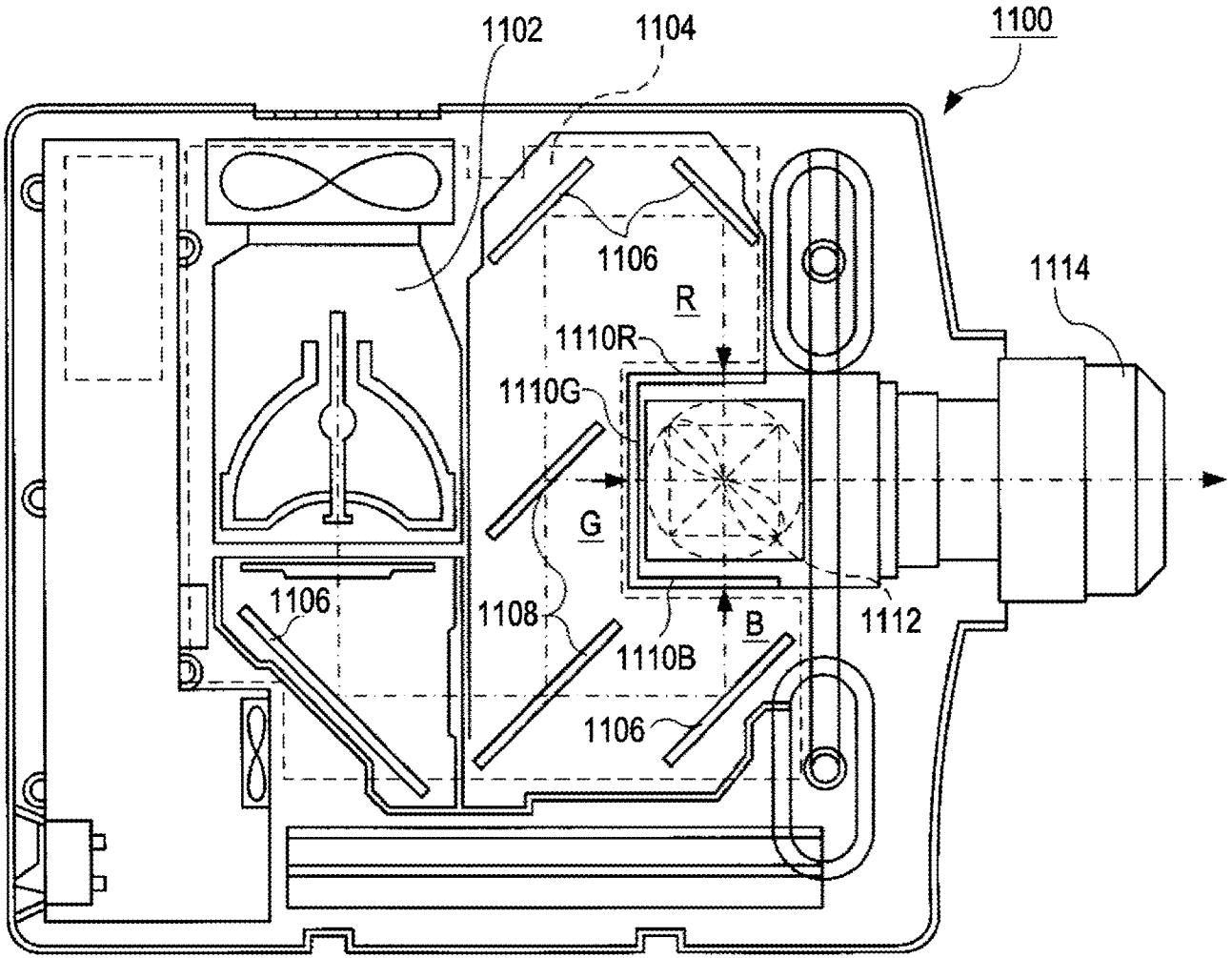
FIG. 11 is a plan view showing a configuration of a projector, i.e., an example of an electronic apparatus to which the electro-optical device is applied.

Various electronic apparatuses to which the liquid crystal device, i.e., the electro-optical device described above, can be applied, will be described. FIG. 11 is a plan view showing a configuration of a projector. The projector includes the liquid crystal device as a light source, and will be described below.

A projector 1100 is shown in FIG. 11. In the projector 1100, a lamp unit 1102 formed by a white light source such as a halogen lamp is provided. A projection light ray emitted by the lamp unit 1102 is divided into three light rays of the primary colors of RGB by four mirrors 1106 and two dichroic mirrors 1108 arranged in a light guide 1104. The RGB light rays enter liquid crystal panels 1110R, 1110G and 1110B which are light sources corresponding to the primary colors.

The liquid crystal panels 1110R, 1110G and 1110B are configured, as the liquid crystal device described above, to be driven by primary color signals of R, G and B provided by an image signal processing circuit, respectively. The light rays modulated by these liquid crystal panels enter a dichroic prism 1112 from three directions. In the dichroic prism 1112, while the R and B light rays are refracted by 90 degrees, the G light ray goes straight. Thus, pictures of every primary color are combined with one another so that a color picture is projected, through a projection lens 1114, onto a screen and so on.

In the above description, regarding display images formed by the liquid crystal panels 1110R, 1110G and 1110B, it should be noted that display image formed by the liquid crystal panel 1110G has to be reversed from right to left with respect to the display images formed by the liquid crystal panels 1110R and 1110B.

Since they are provided with light rays corresponding to the three primary colors of RGB from the dichroic mirrors 1108, the liquid crystal panels 1110R, 1110G and 1110B need no color filters.

In addition to the electronic apparatus described with reference to FIG. 11, the invention may also be applied to a mobile personal computer, a mobile phone, a liquid crystal TV, a video tape recorder of a viewfinder type or of a direct monitor type, a vehicle navigation device, a pager, a personal digital assistant, a calculator, a word processor, a workstation, a TV phone, a POS terminal, a device having a touch panel and so on. The invention, needless to say, may be applied to such various kinds of electronic apparatuses.

The invention may be applied to, in addition to the liquid crystal device of the embodiment described above, a reflective liquid crystal device (LCOS), a plasma display, an electric field emission display (FED, SED), an organic electroluminescence display, a digital micro-mirror device (DMD), an electrophoresis device and so on.

The invention is not limited to the above embodiment, and may be properly modified within the substance or the thought of the invention that may be read from the claims and the entire specification. Such modifications of the driver circuit, the method for driving, the electro-optical device and the electronic apparatus are included within the scope of the invention.

The entire disclosure of Japanese Patent Application No. 2008-049295, filed Feb. 29, 2008 is expressly incorporated by reference herein.

What is claimed is:

1. A driver circuit for driving an electro-optical device, the driver circuit comprising:

a data signal output unit that outputs two kinds of output signal, one of the two kinds of output signal being data signals for displaying a picture, and the other of the two kinds of output signal being a first reference signal for adjusting a signal level of the data signals;

a timing signal output unit that provides the data signal output unit with timing signals for specifying supply timings of the data signals, the timing signals including at least one enable signal;

a detection unit that detects a signal level of the first reference signal provided by the data signal output unit;

a switch unit that switches the data signals provided by the data signal output unit to the first reference signal before the detection unit detects the signal level;

an adjustment unit that adjusts the signal level of the first reference signal provided by the data signal output unit so as to approach a standard value; and a signal control unit that controls the timing signal output unit to stop supply of the timing signals during the detection unit detecting the signal level of the first reference signal.

2. The driver circuit according to claim 1, further comprising a second reference signal output unit that is configured to output a second reference signal having a signal level for adjusting a signal level of the data signals, and an arithmetic unit that is configured to calculate a difference between the signal level of the first reference signal and the signal level of the second reference signal, wherein the adjustment unit is configured to adjust the signal level of the first reference signal provided by the data signal output unit so as to approach the standard value on the basis of the difference.

3. The driver circuit according to claim 1, wherein the detection unit is configured to detect the signal level in a predetermined period of time after a power supply of the electro-optical device is turned on.

4. The driver circuit according to claim 1, wherein the signal control unit is configured to control the timing signal output unit so as to stop an enable signal that is one of the timing signals.

5. An electro-optical device comprising the driver circuit according to claim 1.

6. An electronic apparatus comprising the electro-optical device according to claim 5.

7. A method for driving an electro-optical device, the method comprising:

outputting data signals by a data signal output unit;

supplying the data signal output unit with the timing signals for specifying supply timings of each of the data signals, the timing signals including at least one enable signal;

switching the data signals to a first reference signal, both of which are outputted by the data signal output unit;

detecting a signal level of the first reference signal;

adjusting the signal level of the first reference signal so as to approach a standard value; and stopping supply of at least one of the timing signals before detecting the signal level.

8. A driver circuit for driving an electro-optical device, the driver circuit comprising:

a data signal output unit that outputs two kinds of output signal, one of the two kinds of output signal being data signals for displaying a picture, and the other of the two kinds of output signal being a first reference signal for adjusting a signal level of the data signals;

a timing signal output unit that provides the data signal output unit with timing signals for specifying supply timings of the data signals, the timing signals including at least one enable signal;

a detection unit that detects a signal level of the first reference signal provided by the data signal output unit;

a switch unit that switches the data signals provided by the data signal output unit to the first reference signal before the detection unit detects the signal level;

an adjustment unit that adjusts the signal level of the first reference signal provided by the data signal output unit so as to approach a standard value; and a signal control unit that controls the timing signal output unit to stop supply of the at least one enable signal before the detection unit detects the signal level of the first reference signal such that the supply of the at least one enable signal is stopped during a portion of a blanking period, the detection of the signal level of the first reference signal and the adjustment of the signal level of the first reference signal being performed during the portion of the blanking period.

9. A method for driving an electro-optical device, the method comprising:

outputting data signals by a data signal output unit;

supplying the data signal output unit with timing signals for specifying supply timings of each of the data signals, the timing signals including at least one enable signal;

switching the data signals to a first reference signal, both of which are outputted by the data signal output unit;

detecting a signal level of the first reference signal;

adjusting the signal level of the first reference signal so as to approach a standard value; and stopping supply of the at least one enable signal before detecting the signal level such that the supply of the at least one enable signal is stopped during a portion of a blanking period, the detection of the signal level of the first reference signal and the adjustment of the signal level of the first reference signal being performed during the portion of the blanking period.

* * * * *